US007041973B2

(12) United States Patent
Schlüter

(10) Patent No.: US 7,041,973 B2
(45) Date of Patent: May 9, 2006

(54) METHOD AND DEVICE FOR THE MASS-SPECTROMETRIC ANALYSIS OF GASES

(75) Inventor: Hans-Jürgen Schlüter, Bremen (DE)

(73) Assignee: Thermo Electron (Bremen) GmbH, Breman (DE)

( * ) Notice: Subject to any disclaimer, the term of this patent is extended or adjusted under 35 U.S.C. 154(b) by 0 days.

(21) Appl. No.: 10/841,851

(22) Filed: May 7, 2004

(65) Prior Publication Data

US 2005/0001159 A1 Jan. 6, 2005

(30) Foreign Application Priority Data

May 13, 2003 (DE) ..... 103 21 648

(51) Int. Cl.
*H01J 49/04* (2006.01)

(52) U.S. Cl. ..... 250/288; 250/423 R; 250/281; 250/282

(58) Field of Classification Search ..... 250/288, 250/281, 282, 423 R
See application file for complete search history.

(56) References Cited

U.S. PATENT DOCUMENTS

| | | | | |
|---|---|---|---|---|
| 5,360,976 | A * | 11/1994 | Young et al. | 250/287 |
| 5,442,175 | A | 8/1995 | Dawson | |
| 6,825,477 | B1 | 11/2004 | Sunner et al. | |

FOREIGN PATENT DOCUMENTS

| | | |
|---|---|---|
| GB | 966715 | 8/1964 |
| GB | 1046628 | 10/1966 |
| JP | 58068855 | 10/1981 |
| JP | 2152142 | 12/1988 |
| WO | WO 94/05034 | 3/1994 |

OTHER PUBLICATIONS

Copy of GB Patent Office Search Report on GB Application No. GB0410158.0 dated Oct. 7, 2004.

* cited by examiner

*Primary Examiner*—Kiet T. Nguyen
(74) *Attorney, Agent, or Firm*—Powell Goldstein LLP; Laurence P. Colton

(57) ABSTRACT

The invention relates to a method for operating a mass spectrometer, in particular a static mass spectrometer, with an ion source and an analyzer. The invention likewise concerns the mass spectrometer. According to the invention, a gas admitted into the mass spectrometer is bonded in a concentrated manner on a cooled surface and then ionized.

11 Claims, 4 Drawing Sheets

METHOD AND DEVICE FOR THE MASS-SPECTROMETRIC ANALYSIS OF GASES

STATEMENT OF RELATED APPLICATIONS

This patent application is based on and claims convention priority on German Patent Application No. 103 21 648.0 having a filing date of 13 May 2003.

BACKGROUND OF THE INVENTION

1. Technical Field

The invention relates to a method for operating a mass spectrometer with an ion source and an analyzer, a gas being admitted into the mass spectrometer, ionized at the ion source and analyzed in the analyzer. In addition, the invention relates to a mass spectrometer with an ion source and an analyzer for the analysis of gases.

2. Prior Art

Static mass spectrometers are used when extreme sensitivity is important. The analysis of noble gases (He, Ne, Ar, Kr, Xe) in rocks, meteorites etc., but also in water samples, is typically concerned. Argon is particularly important. Sometimes the term "noble-gas mass spectrometer" is therefore customary. However, such mass spectrometers can also be used for the analysis of gases such as $CO_2$ or $N_2$.

The static mass spectrometer comprises an ion source, an analyzer, in particular, but not necessarily, with a magnetic sector, and a collector, for instance a Faraday cup, or secondary electron multipliers (SEM). Of course, the static mass spectrometer also has devices for producing a high vacuum, that is a pump with a corresponding system of lines. During a measurement, the gas to be analyzed is not pumped out of the static mass spectrometer. Rather, the mass spectrometer is disconnected from the pump after evacuation and then the gas to be analyzed (sample gas) is admitted and distributes itself in the mass spectrometer (ion source, analyzer and collector region). The bonding of reactive gases by so-called getters is known.

In conventional static mass spectrometers, the gases to be analyzed are ionized in the ion source by electron impact. In this case, the gas particles are bombarded with electrons of high kinetic energy (for example 40 to 150 eV). Ionization by laser bombardment is likewise possible.

The known ionization of the gas by electron impact is not particularly effective. The density of the particles to be ionized is relatively low in the gas phase. This results in an only low ion current. This cannot be compensated by increasing the amount of the gas to be analyzed, since the amounts of gas available are generally minimal. The highest possible number of ions is also desirable for reasons of ion counting statistics—more accurate measurement results with an increasing number of ions. Conventional static mass spectrometers operate with typical sensitivities of approximately 1 mA/Torr of gas pressure. A higher value is aimed for. One disadvantage of the conventional mass spectrometers in connection with electron impact ionization is also the high energy width of the ions generated. This limits the achievable mass resolution, in particular in the case of single-focusing mass spectrometers.

BRIEF SUMMARY OF THE INVENTION

The object of the present invention is to provide a method and a device by which mass-spectrometric analyses can be carried out with greater sensitivity—preferably by static mass spectrometers. In particular, a higher and more concentrated ion current is to be made available.

The method according to the invention is characterized in that the gas is bonded in a concentrated manner on a cooled surface and then ionized. The individual gas particles are randomly distributed in the mass spectrometer. The particle density is extremely low due to the small amount of available gas to be analyzed. The cooling of the gas on a surface as provided by the invention brings about a concentration of the gas particles at the surface, so that an ionization at this location permits a higher ion current. The surface may be constantly cooled or only cooled after admission of the gas (sample gas).

According to a further idea of the invention, the gas is preferably cooled only to the extent that diffusion movements of the gas particles on the cold surface are possible. Although the gas particles are bonded on the surface, they remain movable in a two-dimensional direction. In the analysis of argon with an initial pressure of approximately $10^{-9}$ mbar ($10^{-7}$ Pa), temperatures of around 50 Kelvin are preferred, for instance 42 to 60 Kelvin or 44 to 52 Kelvin. For the analysis of other gases and other initial pressures, other temperatures may be required and determined by experiments. The initial pressure is the pressure in the mass spectrometer shortly after admission of the sample gas.

Cooling of the gas until a liquid or solid state of aggregation is reached is likewise within the scope of the invention.

The gas bonded on the surface, in particular in a movable manner, is advantageously ionized there by an electric field (field ionization). The starting location for the ion current formed is defined by the location of the cooled surface. When the mass spectrometer is formed as a sector-field mass spectrometer, this improves the focusability of the ion current on the entry slit of the analyzer. Implantations in beam-limiting surface areas and resultant memory effects are reduced. A further advantage of field ionization, in particular in connection with a sector-field mass spectrometer, is that the energy width of the ions is very small, since all start from the same potential.

A configuration in which the ionization takes place by electron impact is also within the scope of the invention. In this case it is scarcely possible to distinguish whether the ions are created directly at the surface or whether the gas particles initially desorb uncharged from the surface, move counter to the electron beam and only thereby are ionized by electron impact. In the second case, the energy width of the ions is somewhat higher, but is likewise suitable for mass-spectrometric analysis. The temperature of the cooling area may in this case be significantly below 50 Kelvin.

Ionization by irradiation with laser light of a defined wavelength is also within the scope of the invention. The laser beam is directed onto the cooled surface. The ion current produced is significantly higher than in the case of conventional methods without the use of a cooled surface. Here, too, the temperature may be significantly below 50 Kelvin.

All types of ionization can be carried out continuously or in a pulsed manner.

The mass spectrometer according to the invention is characterized by the following features:

a) the ion source is assigned a cooled surface, b) the cooling of the surface is such that the gas is bonded on the surface, c) the gas can be ionized by the surface.

The cooled surface is advantageously a component part of the ion source. If field ionization is used, the surface may have one or more sharp points, at which the gas atoms or molecules are ionized on account of the high field strengths present there. Spindt electrodes are advantageously used. These may be arranged in the manner of an array (Spindt type of field-emission array). One advantage of this type of design is the integration in the surface of the counter-electrode required for producing the high electric field. Arrays are understood as also including surfaces on which the points are not arranged in an exactly orderly way (rows/columns). Spacings between the points of $0.2\times10^{-6}$ to $10\times10^{-6}$ m are advantageous.

Alternatively, micro-structured metal surfaces and/or carbon nanotube arrays may be used.

The idea on which the invention is based, that is of increasing the ion current by local cooling of the gas present in a very low density with subsequent ionization, may also be of interest for other applications, at least for producing ions from gas in general. The intensity of the cooling is to be set according to the gas, the application and the properties of the cooled surface. Generally, the concentration of the gas particles by cooling on a surface may be referred to as freezing out. This does not automatically mean that a solid state of aggregation is reached. What is more important is the achievement of the advantages aimed for, that is the ionization of concentrated molecules or atoms by contrast with the spatial distribution in the case of a gaseous state of aggregation.

BRIEF DESCRIPTION OF THE DRAWINGS

Further features of the invention emerge from the rest of the description and from the claims. Advantageous embodiments are explained in more detail below on the basis of drawings, in which:

DETAILED DESCRIPTION OF THE PREFERRED EMBODIMENTS

Figure 1:
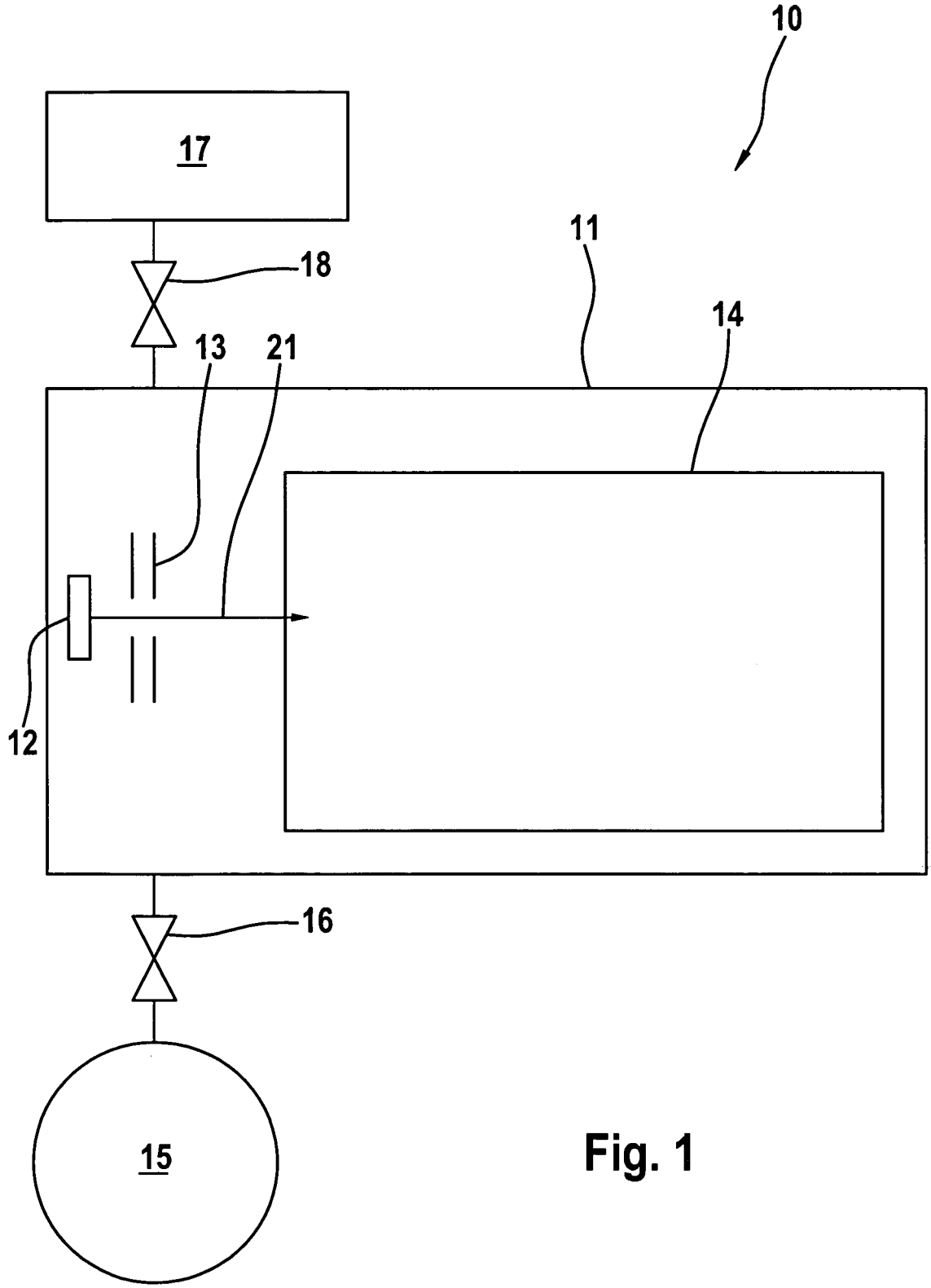
FIG. 1 shows a simplified representation of a mass spectrometer with an ion source, an ion optical system, an analyzer, a gas inlet and a pumping system.

A mass spectrometer 10, in particular a static sector-field mass spectrometer, has in this case a volume 11 which can be sealed and in which an ion source 12, an ion optical system 13 and an analyzer 14 with a collector (not shown) are arranged. The ion optical system 13 may be, but does not have to be, part of the ion source 12.

The volume 11 can be evacuated by a pumping system 15, which can be disconnected from the volume 11 by a valve 16. A gas sample can be fed into the volume 11 via a gas inlet 17 with an associated valve 18.

Figure 3:
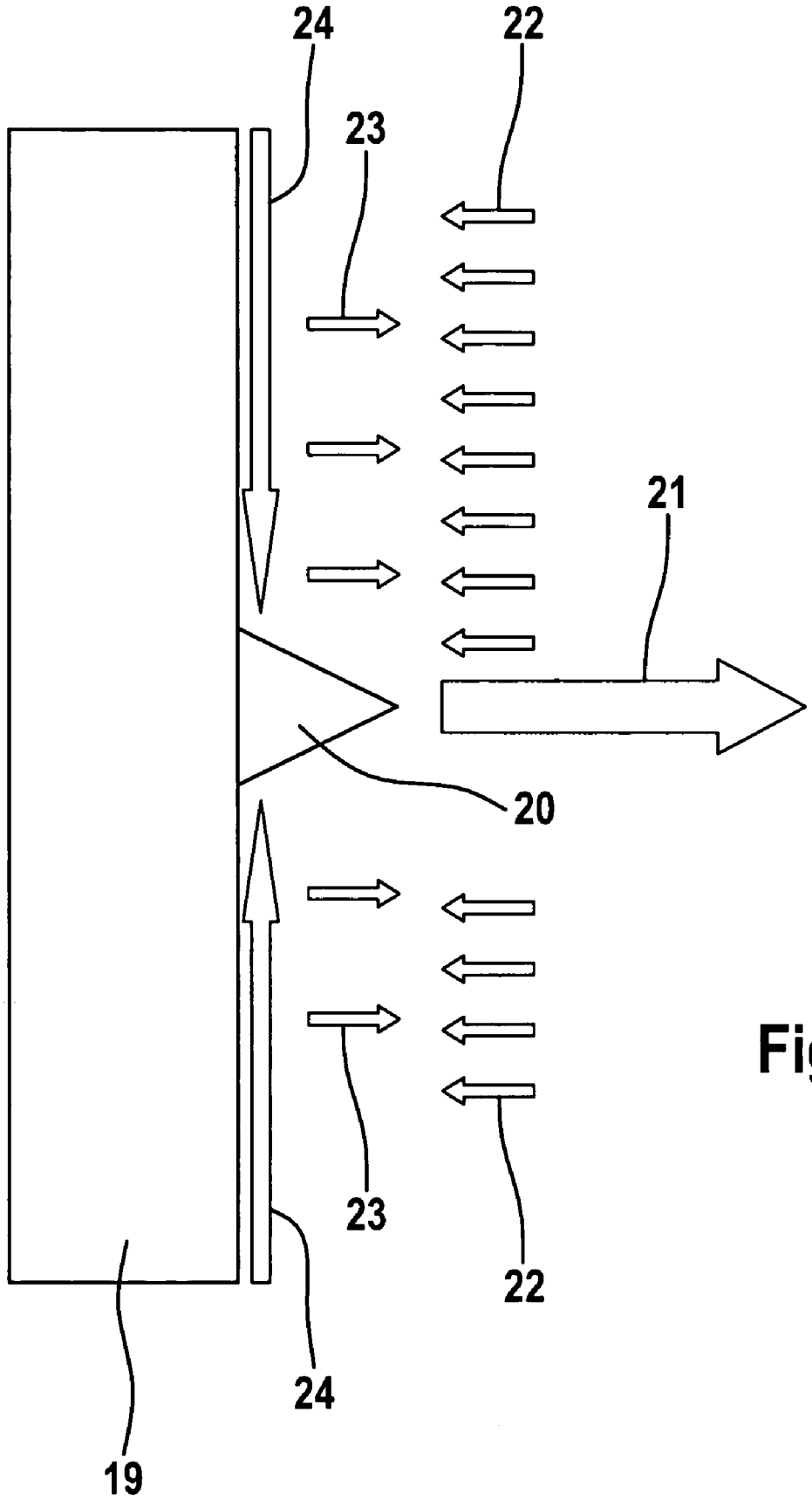
FIG. 3 shows a cross section through the cooling area with a point to represent the particle streams (adsorption, desorption, surface diffusion, field emission).
Figure 4:
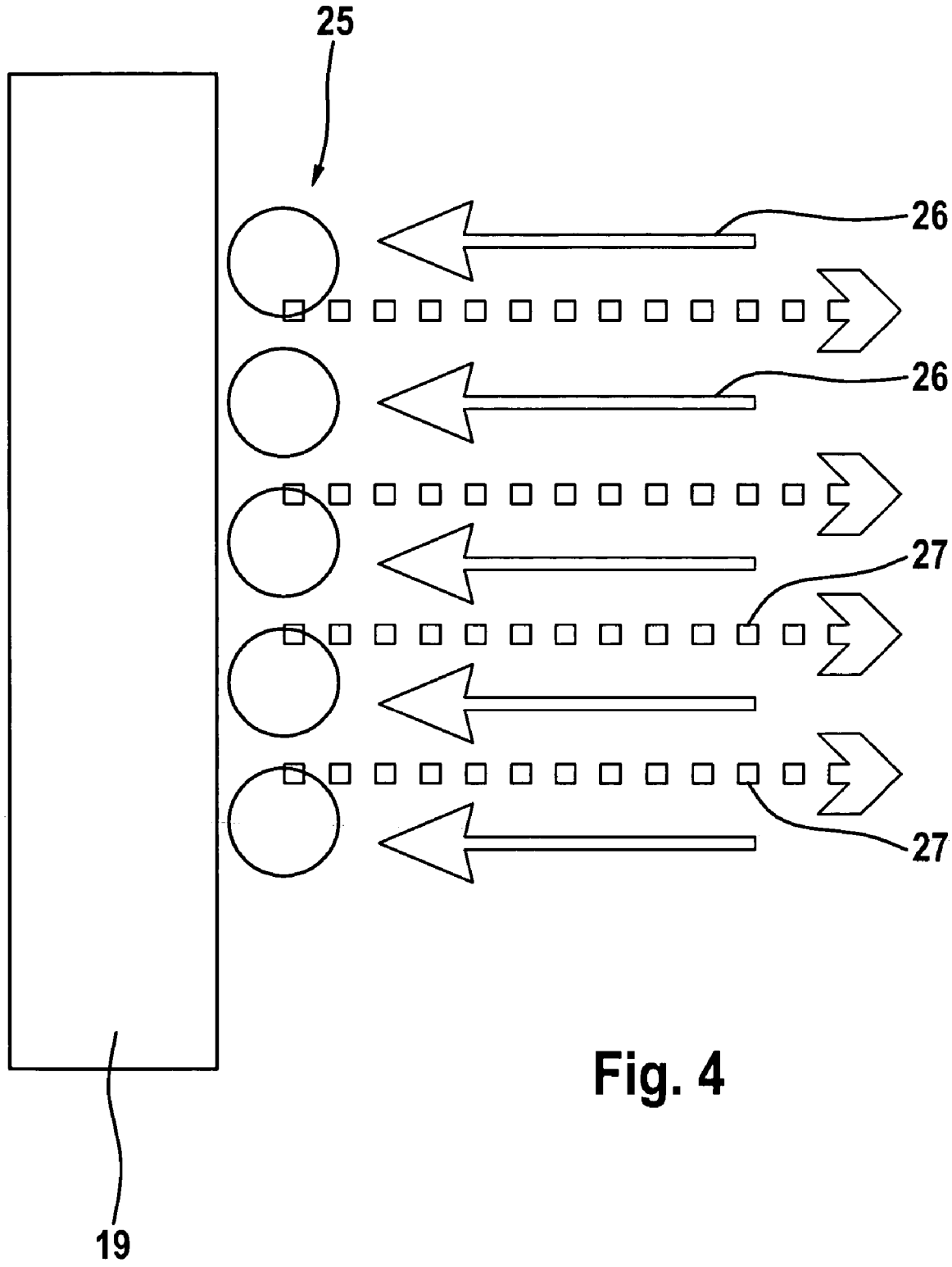
FIG. 4 shows a cross section through a cooling area to explain ionization by electron impact, with adsorbed gas particles, electrons, neutral gas particles and ions represented.

The ion source 12 has in this case a cooled surface, that is a cooling area 19 (FIGS. 3, 4). For ion generation by field ionization, the cooling area 19 is at the same time part of a Spindt electrode array or a field-emission array of the Spindt type. A Spindt electrode has a sharp point 20, in the region of which there is an electric field strength adequate for ionization. The ionized gas particles leave in the region of the point 20 as an ion current 21 in the direction of the analyzer 14. Other, similarly acting micro-structured surfaces, for example made of metal, are also suitable for field ionization.

According to FIG. 3, gas atoms (arrows 22) are adsorbed on the surface 19. Some of the adsorbed atoms desorb again into the gas phase (arrows 23). Many of the adsorbed atoms diffuse along a concentration gradient (arrows 24) (electric field strength) along the surface of the cooling area 19 to the point 20, at which the ionization takes place.

An alternative configuration of the ion source or type of ionization is illustrated by FIG. 4. The spherically represented gas particles 25 are adsorbed at the surface of the cooling surface 19. Electrons (continuous arrows 26) impinge on the gas particles 25 and in this way generate ions moving in the opposite direction (dashed arrows 27). In actual fact, neutral gas particles constantly desorb from the surface of the cooling surface 19 and move parallel to the ions. Many of the neutral gas particles are likewise impinged by the electrons 26 and ionized. The dashed arrows 27 consequently represent a mixture of desorbed neutral gas particles and ions near the surface of the cooling area 19, the proportion of the neutral gas particles strongly decreasing as the distance from the cooling area 19 increases.

Figure 2:
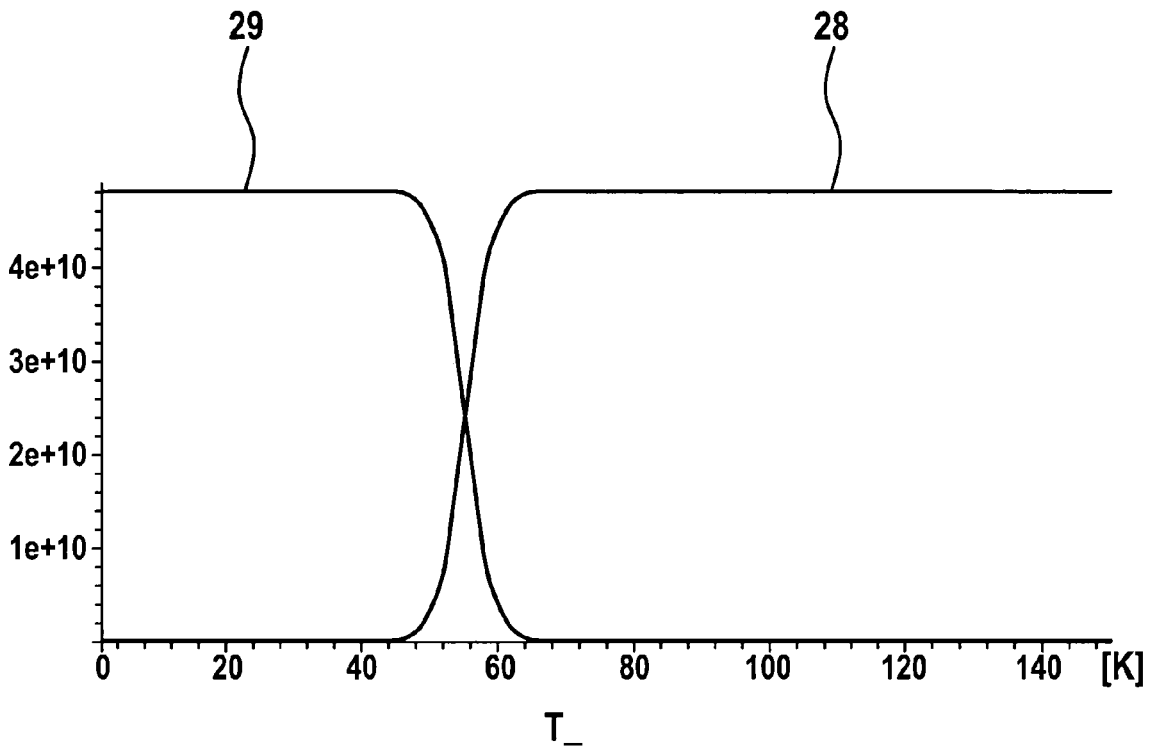
FIG. 2 shows the distribution of the gas between the free gas phase and a surface of a solid body (cooling area) in dependence on the temperature of the cooling area.

FIG. 2 illustrates the distribution of argon between the free gas phase on the one hand and the fraction adsorbed on the surface of the cooling area 19 on the other hand. This is based on the following parameters:

cooling area 19 with a surface of 10 $mm^2$, the surface is a Spindt electrode array with spacings between the individual Spindt electrodes of $2\times10^{-6}$ m (providing $2.5\times10^{6}$ points), adsorption energy 13 kJ/mol, volume 11 with a content of 2 litres, total amount of argon particles $5*10^{10}$, initial pressure $10^{-7}$ Pa.

The curve 28 to the right in FIG. 2 represents the number of particles in the gas phase; in a corresponding way, the curve 29 represents the number of particles on the surface of a solid body (surface of the cooling area 19), in each case in dependence on the absolute temperature given in Kelvin. It can be seen from the representation that, even with cooling to 52 Kelvin, there are significantly more gas particles bonded on the surface of the solid body than there are in the gas phase. A good practical value for the analysis of argon is 50 Kelvin. In the case of a larger cooling area 19 and/or a higher adsorption energy than 13 kJ/mol, both curves 28, 29 shift to the right. For the freezing out of other gases, for example helium, neon, krypton or xenon, other temperatures may be advantageous for the high ion current aimed for.

In actual fact, the device represented in FIG. 1 is operated as follows:

The volume 11 is largely evacuated by the pumping system 15. Subsequently, the valve 16 is closed. After that, a defined amount of gas—argon to be analyzed—is admitted via the gas inlet 17. Subsequently, the initial pressure prevails. The gas particles move in the volume 11, which comprises the cooling area 19 cooled down to 50 Kelvin, and are in this way frozen out on the cooling area 19. Subsequently, the ionization of the gas particles takes place in the way stated further above.

List of Reference Numerals

10 mass spectrometer
11 volume
12 ion source
13 ion optical system
14 analyzer
15 pumping system
16 valve
17 gas inlet
18 valve
19 cooling area
20 point
21 ion current
22 arrows
23 arrows
24 arrows
25 gas particles
26 electrons
27 dashed arrows
28 curve
29 curve

What is claimed is:

1. Method of operating a static mass spectrometer (10), with an ion source (12) and an analyzer (14), comprising the steps of:

a) evacuating the mass spectrometer;

b) admitting a gas into the mass spectrometer;

c) bonding the gas in a concentrated manner on a surface with the ion source of the mass spectrometer by cooling said surface;

d) ionizing the gas on the cooled surface within the ion source; and e) analyzing the ionized gas in the analyzer.

2. Method according to claim 1, characterized in that the gas is cooled only to the extent that diffusion movements are still possible on the cooled surface.

3. Method according to claim 2, characterized in that the gas is ionized by an electric field (field ionization).

4. Method according to claim 2, characterized in that the gas is ionized by electron impact.

5. Method according to claim 2, characterized in that the gas is ionized by irradiation with laser light.

6. Method according to claim 1, characterized in that the gas is ionized by an electric field (field ionization).

7. Method according to claim 1, characterized in that the gas is ionized by electron impact.

8. Method according to claim 2, characterized in that the gas is ionized by irradiation with laser light.

9. Method according to claim 1, characterized in that the gas is cooled to temperatures in the range of approximately 42 K to 60 K.

10. Method according to claim 1, characterized in that the gas is cooled until a liquid or solid state of aggregation is reached.

11. Method according to claim 1, characterized in that the initial pressure in the mass spectrometer is approximately $10^{-9}$ mbar ($10^{-7}$ Pa).

* * * * *